US011898104B2

(12) United States Patent
Schuber et al.

(10) Patent No.: US 11,898,104 B2
(45) Date of Patent: Feb. 13, 2024

(54) SULFIDE SCAVENGING USING BIODEGRADABLE COMPLEXES

(71) Applicant: Solugen, Inc., Houston, TX (US)

(72) Inventors: Paul Schuber, Sugar Land, TX (US); Toni M. Lee, Missouri City, TX (US); Jun Su An, Houston, TX (US); Jason Helander, Richmond, TX (US); Tom Swanson, Houston, TX (US); Gaurab Chakrabarti, Houston, TX (US); Sean Hunt, Houston, TX (US); Chris Arceo, Richmond, TX (US)

(73) Assignee: SOLUGEN, INC., Houston, TX (US)

( * ) Notice: Subject to any disclaimer, the term of this patent is extended or adjusted under 35 U.S.C. 154(b) by 0 days.

(21) Appl. No.: 17/995,161

(22) PCT Filed: Apr. 5, 2021

(86) PCT No.: PCT/US2021/025829

§ 371 (c)(1),
(2) Date: Sep. 30, 2022

(87) PCT Pub. No.: WO2021/207104

PCT Pub. Date: Oct. 14, 2021

(65) Prior Publication Data

US 2023/0227733 A1 Jul. 20, 2023

Related U.S. Application Data

(60) Provisional application No. 63/005,344, filed on Apr. 5, 2020.

(51) Int. Cl.

| | |
|---|---|
| ***C10G 27/10*** | (2006.01) |
| ***C10G 29/04*** | (2006.01) |
| ***C10G 53/14*** | (2006.01) |

(52) U.S. Cl.

CPC ..... *C10G 27/10* (2013.01); *C10G 29/04* (2013.01); *C10G 53/14* (2013.01); *C10G 2300/207* (2013.01)

(58) Field of Classification Search

CPC ..... C10G 27/10; C10G 29/04; C10G 29/06; C10G 53/14; C10G 2300/207; C02F 1/20; C02F 1/72; C02F 1/74; C02F 2101/10; B01D 53/52

See application file for complete search history.

(56) References Cited

U.S. PATENT DOCUMENTS 3,767,689 A 10/1973 Donovan et al.
4,076,621 A 2/1978 Hardison
4,830,838 A 5/1989 Kent et al.
5,026,503 A * 6/1991 Stewart ..... B01D 53/1468 252/189
9,254,453 B2 2/2016 McDaniel et al.
(Continued)

OTHER PUBLICATIONS

PCT/US2021/025829 International Search Report and Written Opinion dated Jul. 7, 2021 (14 p.).
(Continued)

*Primary Examiner* — Renee Robinson

(74) *Attorney, Agent, or Firm* — CONLEY ROSE, P.C.

(57) ABSTRACT

A method for removal of sulfide from a stream, the method comprising preparing a metal-chelant complex, designated M-Yn, where M is a divalent or trivalent cation, Y comprises a gluconic acid, glucaric acid or derivative thereof, and n is from about 1 to about 3; contacting a mixture comprising M-Yn and a base with a sulfide stream under conditions suitable for the formation of a metal-sulfide species; and contacting the metal-sulfide species with an oxidizing agent to form a soluble metal sulfide species. A method for removal of sulfide from a stream, the method comprising preparing a sulfide scavenging mixture comprising a base and a metal-complex characterized by Structure (I); contacting the sulfide scavenging mixture with a sulfide stream under conditions suitable for the formation of a metal-sulfide species; and contacting the metal-sulfide species with an oxidizing agent to form a soluble metal sulfide species.

FIG. 1

Glucaric acid

Gluconic acid (I)

21 Claims, 4 Drawing Sheets

(56) References Cited

U.S. PATENT DOCUMENTS

2004/0192995 A1* 9/2004 Deshpande ..... C01B 17/05 585/855
2014/0251922 A1* 9/2014 McDaniel ..... C02F 1/52 423/226

OTHER PUBLICATIONS

Zhao, Wei-rong et al., "Modeling of Mass Transfer Characteristics of Bubble Column Reactor with Surfactant Present," Journal of Zhejiang University Science, vol. 5, 2004, pp. 714-720 (7 p.).
Frauenkron, Matthias et al., "Ethanolamines and Propanolamines," Ullmann's Encyclopedia of industrial Chemistry, vol. 13, 2012, pp. 412-415 (4 p.).
Wikipedia: Base (Chemistry), Dec. 18, 2019, retrieved from https://en.wikipedia.org/w/index.php?title=Base_(chemistry)&oldid=931285220 (9 p.).
Wikipedia: Iron (III), Apr. 6, 2019, retrieved from https://en.wikipedia.org/w/index.php?title=Iron(III)&oldid=891244137 (4 p.).
Chemical Book: "Amino-2-propanol," Mar. 8, 2018, retrieved from http://web.archive.org/web/20180308165821 / https://www.chemicalbook.com/ChemicalProductProperty_EN_CB2366612.htm (5 p.).
Chemical Book: "Sodium Sulfite," Jul. 23, 2018, retrieved from <https://web.archive.org/web/20180723210933/http://www.chemicalbook.com/Chemica1ProductProperty_EN_CB4111698.htm (3 p.).
Steiner, Abram A. et al., "Recipe for Ferric Salts of Ethylenediaminetetraacetic Acid," Plant Physiol, vol. 46, 1970, pp. 862-862 (2 p.).
Amosa, M.K. et al., "Sulphide Scavengers in Oil and Gas Industry—A Review," NAFTA, vol. 61, No. 2, 2010, pp. 85-92 (8 p.).
Chung, Ying-Chien et al., "Operations Optimization of Thiobacillus Thioparus CH11 Biofilter for Hydrogen Sulfide Removal," Journal of Biotechnology, vol. 52, 1996, pp. 31-38 (8 p.).
"Experiment 6: Synthesis of an Iron(III)-EDTA Complex," Resource Book for Sixth-Form Practical Chemistry, pp. 38-41 (4 p.).
Feng, Zhaohui et al., "Acrolein is a Major Cigarette-Related Lung Cancer Agent: Preferential binding at p53 Mutational Hotspots and Inhibition of DNA Repair," PNAS, vol. 103, No. 42, Oct. 17, 2006, pp. 15404-15409 (6 p.).
Maia, Djeine Cristina Schiavon et al., "Removal of H2S and CO2 from Biogas in Bench Scale and the Pilot Scale Using a Regenerable Fe-EDTA Solution," Accepted Manuscript to Appear in Renewable Energy, Mar. 23, 2017 (23 p.).
Introduction to H2S Scavenging—GATE Energy (https://www.gate.energy/the-brainery/gat2004-gkp-2014-04/introduction-to-h2s-scavenging).
Mitchell, R.E. et al., Kinetic and Equilibrium Constants of the Gluconic Acid-Gluconnolactone System, Annals of the New York Academy of Science, vol. 172, 1970, pp. 131-138 (8 p.).
Swenberg, James A. et al., "Formaldehyde Carcinogenicity Research: 30 Years and Counting for Mode of Action, Epidemiology, and Cancer Risk Assessment," Toxicol Pathol., Feb. 2013, vol. 41, No. 2, pp. 181-189 (17 p.).
Wang, Hsiang-Tsui et al., "Effect of Carcinogenic Acrolein on DNA Repair and Mutagenic Susceptibility," The Journal of Biological Chemistry, vol. 287, vol. 15, Apr. 6, 2012, pp. 12379-12386 (8 p.).
Sonmez, Hatice Gülsah, "Techno-Economic Evaluation of a Liquid Redox Process Employing Amino Acid Salts for Sour Natural Gas Treatment," Technische Universitaet Berlin (Germany) ProQuest Dissertations Publishing, 2017 (228 p.).
Zhang, Lehua et al., "Chemical and Biological Technologies for Hydrogen Sulfide Emission Control in Sewer Systems: A Review," Water Research, vol. 42, 2008, pp. 1-12 (12 p.).
OSHA: Hydrogen Sulfide (https://www.osha.gov/hydrogen-sulfide).
OSHA: Hydrogen Sulfide Fact Sheet (https://www.osha.gov/sites/default/files/publications/hydrogen_sulfide_fact.pdf).
Wagoner, Michael et al., "Understanding the Impacts of Crude Oil H2S Scavengers on Refinery Process Operations," Corcon, Sep. 17-20, 2017, Mumbai, India, Paper No. CR11 (10 p.).

* cited by examiner

Gluconic acid

Glucaric acid

SULFIDE SCAVENGING USING BIODEGRADABLE COMPLEXES

CROSS-REFERENCE TO RELATED APPLICATIONS

This application is a 35 U.S.C. § 371 national stage application of PCT/US2021/025829 filed Apr. 5, 2021, and entitled "Sulfide Scavenging Using Biodegradable Complexes, which claims benefit of U.S. provisional patent application Ser. No. 63/005,344 filed Apr. 5, 2020, and entitled "Sulfide Scavenging Using Biodegradable Complexes," each of which is hereby incorporated herein by reference in its entirety for all purposes.

FIELD

The present disclosure relates generally to the removal of sulfide-containing compounds from fluid and gas streams. More particularly, this disclosure relates to the use of biodegradable transition metal complexes for the oxidation of sulfide.

BACKGROUND

Hydrogen sulfide ($H_2S$) can be dangerous to personnel working in oil and gas, municipal wastewater treatment, agriculture, tanneries, paper mills, and other industries that generate the compound at concentrations hazardous to human and animal life (generally ≥10 ppm). Hydrogen sulfide is also extremely corrosive to most metals and concrete. As such, it can cause the cracking of drill pipes and tubular goods, the destruction of testing tools and wire lines in oil and gas, as well as corrosion of sewer systems. The presence of hydrogen sulfide is further objectionable because it often reacts with desirable hydrocarbons, as well as fuel system components.

SUMMARY

Disclosed herein is a method for removal of sulfide from a stream, the method comprising preparing a metal-chelant complex, designated M-Yn, where M is a divalent or trivalent cation, Y comprises a gluconic acid, glucaric acid or derivative thereof, and n is from about 1 to about 3; contacting a mixture comprising M-Yn and a base with a sulfide stream under conditions suitable for the formation of a metal-sulfide species; and contacting the metal-sulfide species with an oxidizing agent to form a soluble metal sulfide species.

Also disclosed herein is a method for removal of sulfide from a stream, the method comprising preparing a sulfide scavenging mixture comprising a base and a metal-complex characterized by Structure I;

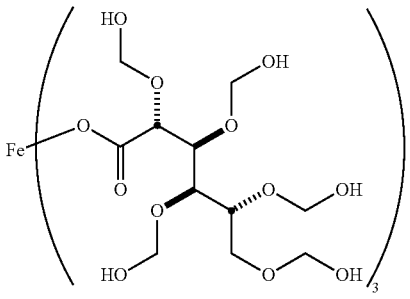

contacting the sulfide scavenging mixture with a sulfide stream under conditions suitable for the formation of a metal-sulfide species; and contacting the metal-sulfide species with an oxidizing agent to form a soluble metal sulfide species.

BRIEF DESCRIPTION OF THE DRAWINGS

For a detailed description of various exemplary embodiments, reference will now be made to the accompanying drawings in which.

DETAILED DESCRIPTION

As noted above, hydrogen sulfide can be dangerous and corrosive. Conventional practices for removal of sulfides in oil and gas applications typically utilize two types of compounds: (1) zinc-based, and (2) iron-oxide (magnetite $Fe_3O_4$ or "ironite sponge")-based. Both approaches suffer from drawbacks. For example, zinc-based chemicals can cause detrimental effects to mud rheology and result in flocculation leading to fluid loss in oil and gas applications while iron-based chemistries are ineffective at high pH. Accordingly, an ongoing need exists for an environmentally-sound, sustainable and effective method of removing sulfides (e.g., $H_2S$) from liquids and gases.

Disclosed herein are compositions and methods for the reduction of sulfide from liquids, gases, or combinations thereof. In one or more aspects, the composition for sulfide reduction (COSR) includes a metal chelant, alternatively a biodgradable metal chelant.

Figure 1:
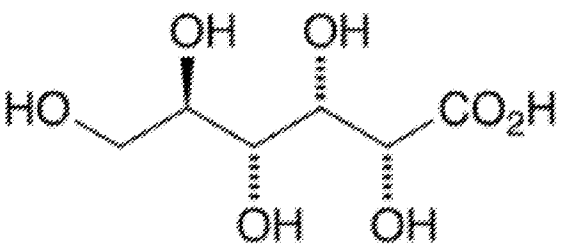
FIG. 1 illustrates the structures of gluaric acid and gluconic acid.
Figure 1:
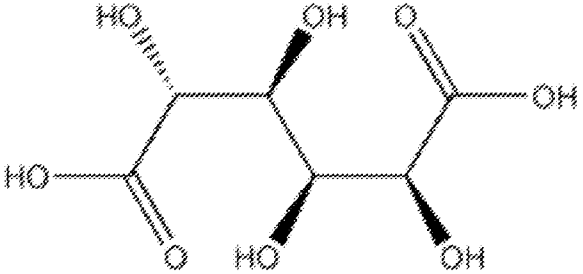

In an aspect, the COSR includes a salt or ester of gluconic acid, alternatively the composition includes gluconate or any derivative thereof. In another aspect, the COSR includes a salt or ester of glucaric acid. The structures of gluaric acid and gluconic acid are shown in FIG. 1.

Molecularly, gluconate is intriguing due to its equilibrium with several cyclic isomers, which can be accessed under certain conditions. The molecule also contains three distinct functional groups, one carboxylic acid, four secondary and one primary hydroxyl group. Due to the presence of multiple functional groups, gluconate can act as a metal chelant. In an aspect, the gluconate functions to chelate a divalent or trivalent metal. Similarly, in an aspect, glucarate functions to chelate a divalent or trivalent metal. In an aspect, the COSR comprises a metal. In an aspect, a metal suitable for use in the COSR is able to form a stable divalent cation ($2^+$) or a stable trivalent cation ($3^+$). In the alternative, a metal suitable for use in the COSR forms a stable monovalent cation. In an aspect, the COSR comprises sodium, potassium, iron (III) copper (II), zinc (II), or any combination thereof.

In an aspect, the COSR is formed by contacting the gluconate or gluconate derivative and metal. In another aspect, the COSR is formed by contacting the glucarate or glucarate derivative and metal. The result is characterized herein as a complex having the general formula M-Yn; where M is a metal; Y is a gluconate or gluconate derivative, or glucarate or glucarate derivative, both of the type disclosed herein; and n is an integer ranging from about 1 to about 5, alternatively from about 1 to 3.

In an aspect, the COSR comprises a gluconate derivative formed by the reaction of a gluconate salt with a polyoxymethylene, or alternatively a gluconate derivative formed from the reaction of a gluconate salt with paraformaldehyde. Paraformaldehyde (PFA) is a poly-acetal and the smallest polyoxymethylene, which is the polymerization product of formaldehyde having a typical degree of polymerization of 8-100 units. Scheme 1 below depicts the reaction of sodium gluconate with paraformaldehyde in the presence of iron (III) chloride to form an iron complex, Structure I, that can function in a COSR. The details for formation of the complex which is described in more detail in the Examples.

Scheme 1

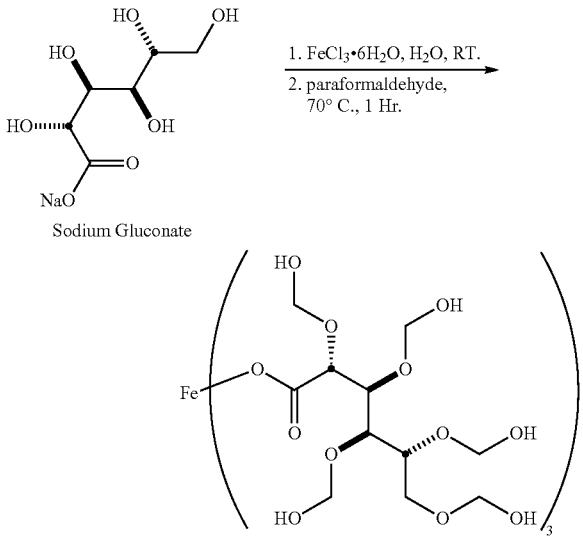

Structure I

A process for removal of sulfide (e.g., from a gas or liquid stream) can include contacting a mixture comprising a COSR of the type disclosed herein with a sulfide stream under conditions suitable for the formation of soluble metal-sulfur complexes. In such aspects, the COSR comprises a gluconate or gluconate derivative. In an alternative aspect, the COSR comprises a glucarate or glucarate derivative. The COSR may be present in an amount of from about 0.5 wt. % to about 50 wt. % based on the total weight of the mixture, alternatively from about 1.0 wt. % to about 45 wt. %, or alternatively from about 5 wt. % to about 40 wt. %.

The sulfide stream can include any stream containing a sulfide compound such as hydrogen sulfide. For example, the stream can comprise a stream containing produced water (e.g., underground water removed with crude oil), crude oil itself, natural gases, and gases associated with underground water and crude oil. Other sulfide streams such as fluids and gases associated with municipal and industrial wastewater, or livestock production can also be used. In an aspect, the hydrogen sulfide gas stream can mix with another production gas mixture, wherein the gas mixture may contain hydrogen sulfide, carbon dioxide, and a hydrocarbon, where each gaseous component can comprise from about 0.5 wt. % to about 99 wt. % based on the total weight of the production gas mixture, alternatively from about 1 wt. % to about 90 wt. %, or alternatively from about 5 wt. % to about 50 wt. %.

In an aspect, the mixture comprises iron, zinc, sodium, potassium or a combination thereof and the mixture is basic or at a pH of greater than about 7, alternatively from greater than about 7 to about 14, or alternatively from about 7.1 to about 14. In such aspects, any base compatible with the other materials present may be contacted with the COSR and sulfide stream in an amount effective to provide the desired pH. In an alternative aspect, the mixture comprises copper and the mixture is acidic or at a pH less than about 7, alternatively from about 1 to about 7, or alternatively from about 4 to about 7.

Any suitable base may be utilized in the COSR. In an aspect, the base is an amine or amine-containing compound. For example, the base may comprise $RNH_3$ where R is a $C_3$ to $C_{30}$ organyl group, alternatively a $C_3$ to $C_{30}$ alkyl group, alternatively a $C_3$ to $C_{30}$ alkyl hydroxyl straight chain group, alternatively a $C_3$ to $C_{30}$ branched alkyl chain, or alternatively a $C_3$ to $C_{30}$ alkoxyl anion. In such aspects, the amine or amine-containing compound are present in an amount of from about 0.5 wt. % to about 50 wt. % based on the total weight of the mixture, alternatively from about 1.0 wt. % to about 45 wt. %, or alternatively from about 5 wt. % to about 40 wt. %. The base may function to deprotonate hydrogen sulfide and generate an anionic sulfur species.

In an aspect, the mixture comprises a solvent. Any solvent compatible with the components of the COSR may be used in an amount effective to meet some user or process need. In an aspect, the solvent is water. The solvent may be present in any amount suitable to meet some user and/or process need.

In an aspect, the mixture (i.e. COSR, amine, solvent) is contacted with the sulfide stream under conditions suitable to form soluble sulfur-containing compounds. A method of the present disclosure further comprises contacting the soluble sulfur-containing compounds with an oxidizing agent. In an aspect, the oxidizing agent is oxygen. For example, air can be sparged through a reactor in which the reaction mixture (e.g., sulfide-containing compound and COSR) is present. Contacting of the reaction mixture with an oxidizing agent results in the formation of insoluble sulfur compounds such as polysulfide that can be easily removed.

In an aspect, disclosed herein is a method of converting hydrogen sulfide to an insoluble sulfide compound. The methods disclosed herein may be performed discontinuously or continuously. In an aspect, hydrogen sulfide is contacted with a metal gluconate, an amine, and a solvent at a pH of greater than about 7 to form a polymer sulfide species. In such aspects, the metal comprises iron, zinc, sodium, potassium or a combination thereof. In an alternative aspect, the metal comprises copper and the pH is less than about 7. In either aspect, the resulting free sulfide species is contacted with an oxidizing agent (e.g., oxygen) and converted to an insoluble sulfide complex such as iron oxide ($Fe_3O_2$). Such methods may be carried out in any suitable vessel or reactor. In an aspect, hydrogen sulfide is contacted with a metal glucarate, an amine, and a solvent at a pH of greater than about 7 to form a polymer sulfide species. In an aspect, the free sulfide species is contacted with an oxidizing agent (e.g., oxygen) and converted to an insoluble sulfide complex such as iron oxide ($Fe_3O_2$). Such methods may be carried out in any suitable vessel or reactor. For example, the methods for sulfide scavenging disclosed herein may be carried out in a continuous fashion in a reactor such as a bubble column. The COSR comprising an environmentally friendly metal biochelant may scavenge sulfide in the presence of aeration (e.g., with $O_2$) resulting in a fluid that can be removed from the column. This is in stark contrast to conventional sulfide scavengers such as triazene, which when utilized in a similar process results in precipitation.

EXAMPLES

The presently disclosed subject matter having been generally described, the following examples are given as particular aspects of the subject matter and to demonstrate the practice and advantages thereof. It is understood that the examples are given by way of illustration and are not intended to limit the specification or the claims in any manner.

Example 1

Figure 2:
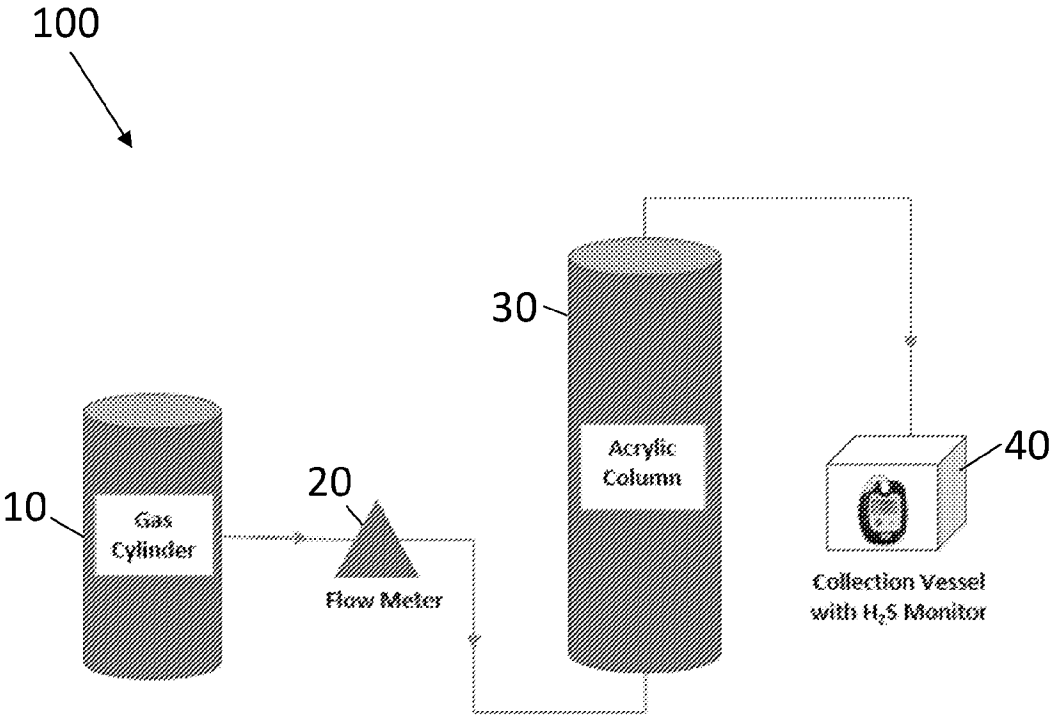
FIG. 2 is a schematic view of the reaction setup described in Example 1.
Figure 3:
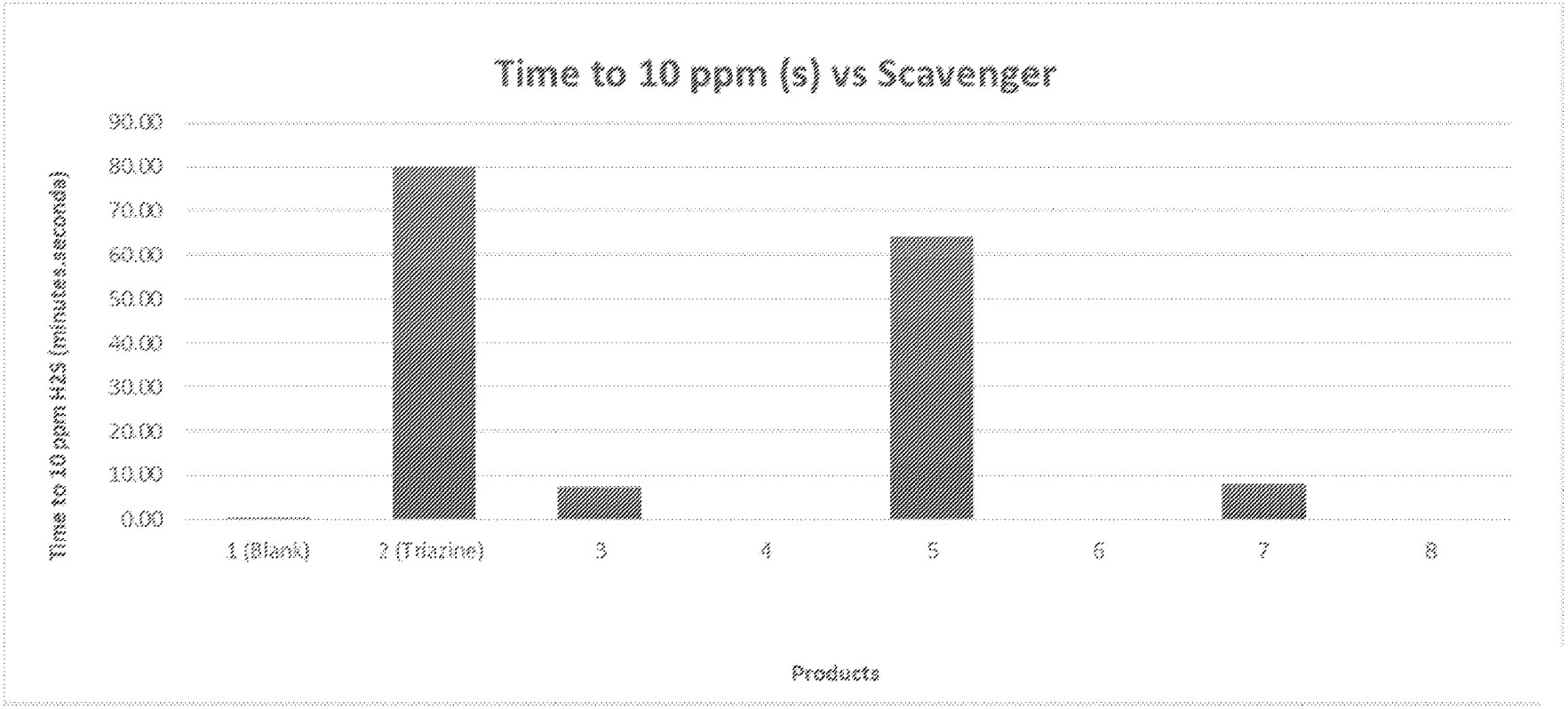
FIG. 3 is a graphical illustration of the results of the experiments described in Example 1.

A series of experiments were conducted in a bubble column to compare gluconate and its derivatives with incumbent chemicals (triazine). In this experiment, the reactor was a bubble column having a polyacrylic column attached to a gas cylinder and this reaction setup 100 is depicted in FIG. 2. The gas cylinder 10 contained a mixture of 0.2% $H_2S$, 5% $CO_2$, and 94.8% $CH_4$. In each test, the formulations being tested were loaded into the polyacrylic column that contained 1% weight in tap water, unless otherwise stated. The gas from the gas cylinder 10 flowed into the bottom of the polyacrylic column 30 at a rate of 500 mL/minute, which was monitored by a flow meter 20 and connected to a $H_2S$ collection vessel 40. The vessel contained an $H_2S$ monitor that measured the ppm of $H_2S$ passing through the polacrylic column. The performance of each formulation was determined by the amount of time taken for the $H_2S$ monitor to reach 10 ppm of gas in the collection vessel. Once the monitor reached 10 ppm, the test was considered complete and the time to reach 10 ppm was recorded. These results are presented in Table 1 and presented graphically in FIG. 3.

TABLE 1

| No. | Formulation | Formulation in tap water | Time to reach 10 ppm (minutes, seconds) | Initial pH of solution | Final pH of solution |
|---|---|---|---|---|---|
| 1 | Blank | N/A | 0.55 | 6.87 | 6.80 |
| 2 | Triazine | 0.5% triazine (77% active) | 80.00 | 9.39 | 6.90 |
| 3 | 3 | 0.5% DEA (85% active) | 7.50 | 11.00 | 9.20 |
| 4 | 4 | 0.5% Fe (III) gluconate | 0.10 | 2.50 | 2.50 |
| 5 | 5 | 0.5% Cu(II) gluconate (100% active) | 64.00 | 4.50 | 3.30 |
| 6 | 6 | 0.5% Sodium gluconate (100% active) | 0.10 | 8.12 | 8.12 |
| 7 | 7 | 0.5% zinc (II) gluconate (100% active) | 8.00 | 6.90 | 5.60 |
| 8 | 8 | 0.5% glucose | 0.30 | 7.80 | 6.80 |

The performance evaluation of iron (III) gluconate, copper (II) gluconate, sodium gluconate, zinc(II) gluconate, and liquid glucose to scavenge $H_2S$ was compared to that of the conventional sulfide scavenger, triazine. The only product that performed as well as triazine was 0.5% copper (II) gluconate. Triazine (Exp. 2) and copper (II) gluconate (Exp. 5) took 80 and 64 minutes, respectively, for the $H_2S$ monitor to reach 10 ppm. Notably, copper(II) gluconate was also the only compound to scavenge $H_2S$ at acidic pH. Iron(III) gluconate, sodium gluconate, zinc(II) gluconate and liquid glucose took 10 seconds, 10 seconds, 8 minutes, and 30 seconds, respectively, for 10 ppm of $H^2S$ to be detected.

Example 2

Figure 4:
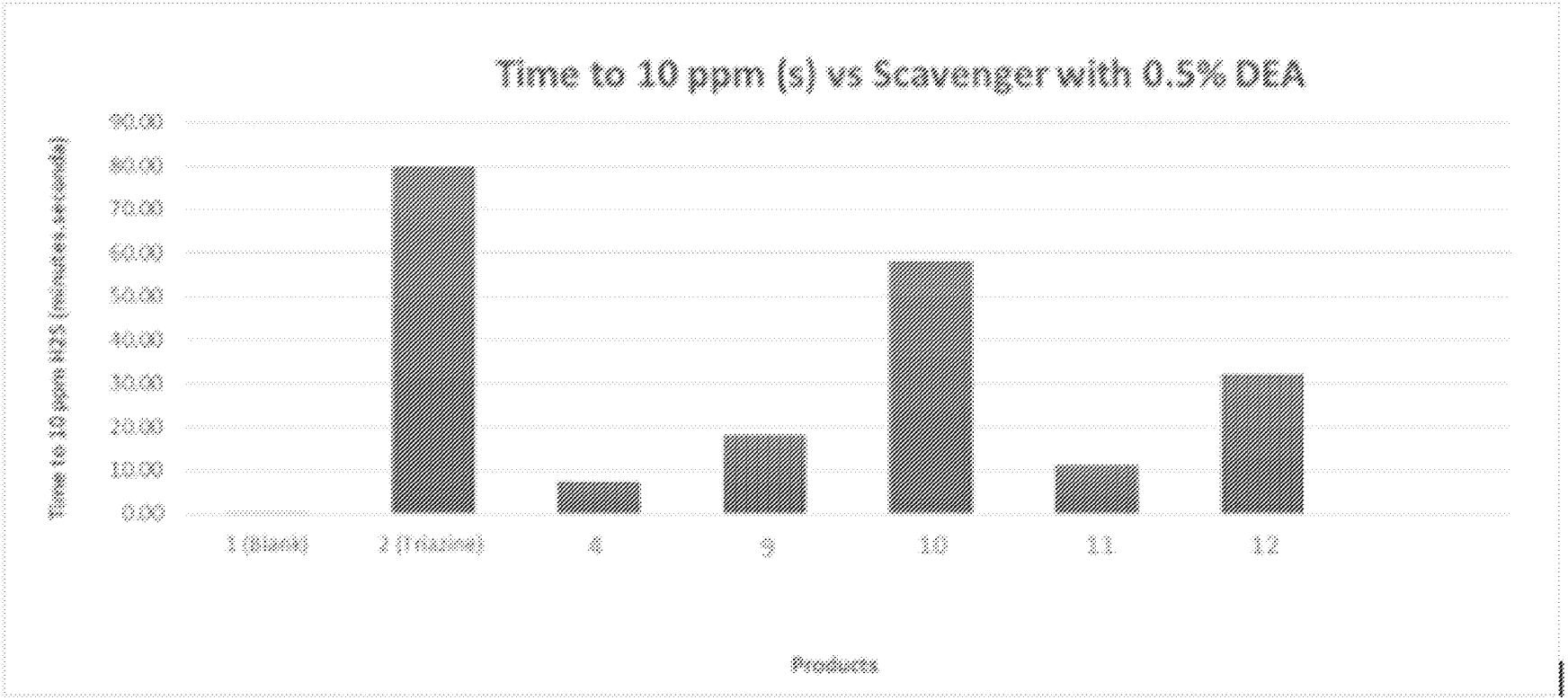
FIG. 4 is a graphical illustration of the results of the experiments described in Example 2.

The effect of diethanolamine (DEA) on the scavenging ability of some of the formulations of Example 1 was investigated. Specifically, 0.5% by wt. DEA was used as a basic catalyst and time for the detection of 10 ppm $H_2S$ determined. These results are presented in Table 2 and graphically in FIG. 4.

TABLE 2

| No. | Formulation | Formulation in tap water | Time to reach 10 ppm (minutes, seconds) | Initial pH of solution | Final pH of solution |
|---|---|---|---|---|---|
| 1 | Blank | N/A | 0.55 | 6.87 | 6.80 |
| 2 | Triazine | 0.5% Triazine(77% active) | 80.00 | 9.39 | 6.90 |
| 4 | 4 | 0.5% DEA (85% active) | 7.50 | 11.00 | 9.20 |
| 9 | 9 | 0.5% Fe (II) gluconate with 0.5% DEA (85% active) | 18.00 | 8.70 | 7.80 |
| 10 | 10 | 0.5% Cu(II) gluconate (100% active) with 0.5% DEA (85% active) | 58.00 | 9.30 | 7.30 |
| 11 | 11 | 0.5% liquid glucose with 0.5% DEA (85% active) | 11.00 | 10.50 | 9.37 |
| 12 | 12 | 0.5% iron (III) gluconate (34% active) with 0.5% DEA (85% active) | 32.00 | 8.80 | 7.40 |

As noted in Example 1, the conventional sulfide scavenger, triazine, took 80 minutes for the $H_2S$ monitor to reach 10 ppm. Notably, the presence of a base, DEA, improved the scavenging ability of the formulations. For example, iron(II) gluconate (Exp. 9) in the absence of DEA reached 10 ppm at 0.10 s while in the presence of DEA that time was extended to 18 minutes. Further, the novel complex of iron (III) gluconate with DEA reached 10 ppm $H_2S$ after 32.00 minutes.

Example 3

Formulation comprising the novel complex of iron (III) gluconate with DEA was allowed to react to completion before exposure to aeration for 4 hours. Prior to aeration the formulation of iron (III) gluconate with DEA was characterized by a black flocculation that upon aeration was converted to a red solution which could be readily separated. The results demonstrate that the COSR provides a novel composition that can scavenge hydrogen sulfide with a metal gluconate compound to give iron sulfide derivative which can be aerated to form a soluble and seperable sulfide compound.

Example 4

A sulfide-scavenging metal complex of the type disclosed herein was prepared as follows:

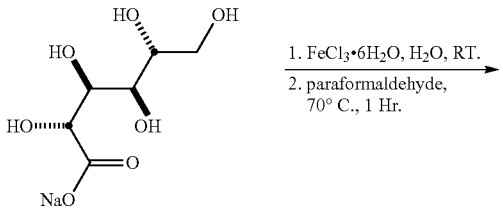

Sodium Gluconate
A

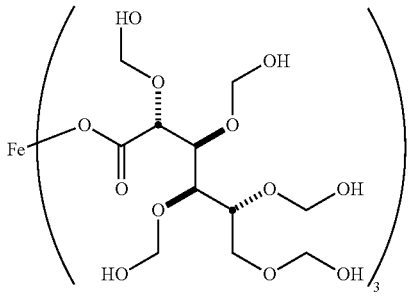

B

To a 500 mL Erlenmeryer flask was added sodium gluconate (20 g, 0.0916 mol. 3 Eq), 20 mL of deionized (DI) water, and a 40% active by wt. solution of $FeCl_3 \cdot 6H_2O$ (20.65 g, 0.03105 mol, 1 Eq). The solution was heated to 70° C. for 1 hr followed by the addition of paraformaldehyde (14.65 g, 0.465 mol, 15 Eq), which was added in small aliquots over a 30 minute time period. Stirring continued for an additional 30 minutes at 70° C. The reaction mixture was cooled to room temperature and transferred to another flask and the weight was recorded. The 65 grams of material was then diluted with 35 grams of deionized water to give 100 grams of B as a 34.15% active solution.

Additional Disclosure

A first aspect which is a method for continuously converting hydrogen sulfide by a metal gluconate compound (0.5-50% by wt.), and 0.5-50.0% wt. of an amine in the presence of solvent (0.5-100% by wt.). The resulting iron sulfide species is converted to $Fe_3O_2$ by air oxidation in a bubble column.

A second aspect which is the method of the first aspect further characterized as a process where a metal gluconate is continuously converting hydrogen sulfide into polymeric sulfur complex with a metal gluconate derivative, wherein the metal gluconate comprised of a copper, iron, zinc, or sodium.

A third aspect which is a metal-gluconate complex and a base which is contacted with hydrogen sulfide. The base deprotonates the hydrogen sulfide to generate a anionic sulfur species. The base may be comprised a straight or branched $C_3$-$C_{30}$ amine where the appendage is an alkyl, alkyl hydroxyl straight chain or branched alkyl chain ($C_3$-$C_{30}$), A fourth aspect which is a metal-gluconate complex and a base which is contacted with hydrogen sulfide. The base functions to deprotonate the hydrogen sulfide and generate an anionic sulfur species, wherein the base is a $C_1$-$C_{30}$ alkoxyl anion where the appendage is an alkyl, alkyl hydroxyl straight chain or branched alkyl chain ($C_3$-$C_{30}$).

A fifth aspect which is a metal-gluconate complex and a base which is contacted with hydrogen sulfide. The hydrogen sulfide gas stream can mix with other production gas mixture, wherein, the gas mixture may contain hydrogen sulfide, carbon dioxide, as well and a hydrocarbon from 0.5% to 99% of each gaseous component.

A sixth aspect which is the method of any of the first through fourth aspect where the metal complex is contacted with hydrogen sulfide. This contacting may result in the metal-gluconate compex forming an iron or copper sulfide derivative as a byproduct, wherein this product can be converted to a liquid upon aeration.

A seventh aspect which is a method for removal of sulfide from a stream, the method comprising preparing a metal-chelant complex, designated M-Yn, where M is a divalent or trivalent cation, Y comprises a gluconic acid, glucaric acid or derivative thereof, and n is from about 1 to about 3; contacting a mixture comprising M-Yn and a base with a sulfide stream under conditions suitable for the formation of a metal-sulfide species; and contacting the metal-sulfide species with an oxidizing agent to form a soluble metal sulfide species.

An eighth aspect which is the method of the seventh aspect wherein contacting of the mixture with the sulfide stream is continuous.

A ninth aspect which is the method of any of the seventh through eighth aspects further comprising removing the soluble metal sulfide species.

A tenth aspect which is the method of any of the seventh through ninth aspects wherein the contacting is carried out in a reactor or a vessel.

An eleventh aspect which is the method of the tenth aspect, wherein the reactor is a bubble column.

A twelfth aspect which is the method of any of the seventh through eleventh aspects wherein the metal forms a stable monovalent cation, a stable divalent cation or a stable trivalent cation.

A thirteenth aspect which is the method of any of the seventh through twelfth aspects wherein the metal comprises sodium, potassium, iron (III), iron (II), copper (II), zinc (II), or a combination thereof.

A fourteenth aspect which is the method of any of the seventh through thirteenth aspects wherein the metal comprises iron (II), iron (III), or both.

A fifteenth aspect which is the method of any of the seventh through fourteenth aspects wherein the oxidizing agent comprises air.

A sixteenth aspect which is the method of any of the seventh through fifteenth aspects wherein the oxidizing agent comprises oxygen.

A seventeenth aspect which is the method of any of the seventh through sixteenth aspects wherein the base comprises amine or amine-containing compound.

An eighteenth aspect which is the method of any of the seventh through seventeenth aspects wherein the base is characterized by the formula $RNH_3$ where R is a $C_3$ to $C_{30}$ organyl group.

A nineteenth aspect which is the method of any of the seventh through eighteenth aspects, wherein the base is present in an amount of from about 0.5 wt. % to about 50 wt. % based on the total weight of the mixture.

A twentieth aspect which is the method of any of the seventh through nineteenth aspects, wherein the metal comprises iron, zinc, sodium, potassium or a combination thereof and wherein the mixture has a pH of greater than about 7.

A twenty-first aspect which is the method of any of the seventh through twentieth aspects wherein the metal comprises copper and wherein the mixture has a pH of less than about 7.

A twenty-second aspect which is a method of removal of sulfide from a stream, the method comprising preparing a sulfide scavenging mixture comprising a base and a metal-complex characterized by Structure I;

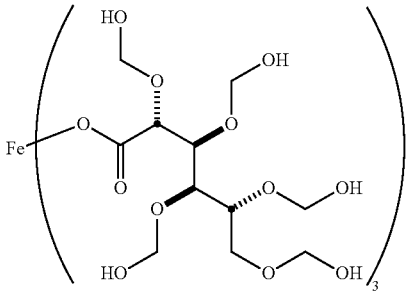

contacting the sulfide scavenging mixture with a sulfide stream under conditions suitable for the formation of a metal-sulfide species; and contacting the metal-sulfide species with an oxidizing agent to form a soluble metal sulfide species.

A twenty-third aspect which is the method of the twenty-second aspect, wherein the oxidizing agent comprises oxygen.

A twenty-fourth aspect which is the method of any of the twenty-second through twenty-third aspects wherein the base comprises amine or amine-containing compound.

A twenty-fourth aspect which is the method of any of the twenty-second through twenty-fourth aspects wherein the base is characterized by the formula $RNH_3$ where R is a $C_3$ to $C_{30}$ organyl group.

A twenty-fifth aspect which is the method of any of the twenty-second through twenty-fourth aspects wherein the base is present in an amount of from about 0.5 wt. % to about 50 wt. % based on the total weight of the mixture.

A twenty-sixth aspect which is the method of any of the twenty-second through twenty-fifth aspects wherein the metal comprises iron, zinc, sodium, potassium or a combination thereof and wherein the mixture has a pH of greater than about 7.

A twenty-seventh aspect which is the method of any of the twenty-second through twenty-sixth aspects, wherein the metal comprises copper and wherein the mixture has a pH of less than about 7.

While aspects of the presently disclosed subject matter have been shown and described, modifications thereof can be made by one skilled in the art without departing from the spirit and teachings of the subject matter. The aspects described herein are exemplary only and are not intended to be limiting. Many variations and modifications of the subject matter disclosed herein are possible and are within the scope of the disclosed subject matter. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an aspect of the present disclosure. Thus, the claims are a further description and are an addition to the aspects of the present invention. The discussion of a reference herein is not an admission that it is prior art to the presently disclosed subject matter, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method for removal of sulfide from a stream, the method comprising:

preparing a metal-chelant complex, designated $M\text{-}Y_n$, where M is a divalent or trivalent cation, Y comprises a gluconic acid, glucaric acid or derivative thereof, and n is from 1 to 3;

contacting a mixture comprising $M\text{-}Y_n$ and a base with sulfide present in the stream under conditions suitable for the formation of a metal-sulfide species; and contacting the metal-sulfide species with an oxidizing agent to form a soluble metal sulfide species.

2. The method of claim 1, wherein contacting of the mixture with the sulfide present in the stream is continuous.

3. The method of claim 1, further comprising removing the soluble metal sulfide species.

4. The method of claim 1, wherein the contacting is carried out in a reactor or a vessel.

5. The method of claim 4, wherein the reactor is a bubble column.

6. The method of claim 1, wherein the metal present in the metal-chelant complex and the metal-sulfide species, upon formation of the metal-sulfide species, forms a stable monovalent cation, a stable divalent cation or a stable trivalent cation.

7. The method of claim 1, wherein the metal present in the metal-chelant complex and the metal-sulfide species comprises sodium, potassium, iron (III), iron (II), copper (II), zinc (II), or a combination thereof.

8. The method of claim 1, wherein the metal present in the metal-chelant complex and the metal-sulfide species comprises iron (II), iron (III), or both.

9. The method of claim 1, wherein the oxidizing agent comprises air.

10. The method of claim 1, wherein the oxidizing agent comprises oxygen.

11. The method of claim 1, wherein the base comprises amine or amine-containing compound.

12. The method of claim 1, wherein the base is characterized by the formula $RNH_3$ where R is a $C_3$ to $C_{30}$ organyl group.

13. The method of claim 1, wherein the base is present in an amount of from about 0.5 wt. % to about 50 wt. % based on the total weight of the mixture.

14. The method of claim 1, wherein the metal present in the metal-chelant complex and the metal-sulfide species comprises iron, zinc, sodium, potassium or a combination thereof and wherein the mixture has a pH of greater than about 7.

15. The method of claim 1, wherein the metal present in the metal-chelant complex and which forms the metal-sulfide species comprises copper and wherein the mixture has a pH of less than about 7.

16. A method for removal of sulfide from a stream, the method comprising:

preparing a sulfide scavenging mixture comprising a base and a metal-complex characterized by Structure I;

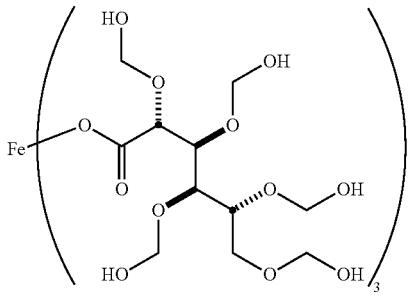

contacting the sulfide scavenging mixture with sulfide present in the stream under conditions suitable for the formation of a metal-sulfide species; and contacting the metal-sulfide species with an oxidizing agent to form a soluble metal sulfide species.

17. The method of claim 16, wherein the oxidizing agent comprises oxygen.

18. The method of claim 16, wherein the base comprises amine or amine-containing compound.

19. The method of claim 16, wherein the base is characterized by the formula $RNH_3$ where R is a $C_3$ to $C_{30}$ organyl group.

20. The method of claim 16, wherein the base is present in an amount of from about 0.5 wt. % to about 50 wt. % based on the total weight of the mixture.

21. The method of claim 16, wherein the mixture has a pH of greater than about 7.

* * * * *